US005500058A

United States Patent [19]

Hirakawa et al.

[11] Patent Number: 5,500,058

[45] Date of Patent: Mar. 19, 1996

[54] METHOD FOR PRODUCING A VEHICULAR ENDLESS TRACK LINK

[75] Inventors: Tetsuro Hirakawa; Masayoshi Kaneko; Katumi Yoshida, all of Chigasaki, Japan

[73] Assignee: Topy Kogyo Kabushiki Kaisha, Tokyo, Japan

[21] Appl. No.: 390,741

[22] Filed: Feb. 17, 1995

[30] Foreign Application Priority Data

Aug. 16, 1994 [JP] Japan ..... 6-192417

[51] Int. Cl.[6] ..... C21D 8/00

[52] U.S. Cl. ..... 148/649; 148/654

[58] Field of Search ..... 148/649, 654; 420/121

[56] References Cited

U.S. PATENT DOCUMENTS 4,419,152 12/1983 Grilli et al. ..... 148/649

5,049,207 9/1991 Sahara et al. ..... 148/503

FOREIGN PATENT DOCUMENTS 57-15076 1/1982 Japan .

57-51583 3/1982 Japan .

59-197336 11/1984 Japan .

59-220467 12/1984 Japan .

5-9488 2/1993 Japan .

*Primary Examiner*—Deborah Yee

*Attorney, Agent, or Firm*—Cushman, Darby & Cushman

[57] ABSTRACT

The present invention relates to a method for producing a link of a vehicular endless track. According to this method, low-carbon boron steel is selected as a starting material for producing the link. The present invention involves the steps of forging and hot-trimming the link material to form a substantially final link shape. Then, the link material is rapidly cooled so that a metallic crystal structure of the link material is converted to martensite. Next, the link material is tempered at a low temperature. Finally, a pin hole and a bushing hole are machine finished in the link material.

17 Claims, 7 Drawing Sheets

METHOD FOR PRODUCING A VEHICULAR ENDLESS TRACK LINK

BACKGROUND OF THE INVENTION

1. Field of the Invention

The present invention relates to a method for producing an endless track link for vehicles such as a power-shovel, a bulldozer, and the like. More particularly the present invention pertains to a method for producing an endless track link wherein a roller contact surface of the link is not subjected to separate high-frequency induction-hardening, tempering, and preliminary machining steps.

2. Description of the Related Art

As illustrated in FIG. 5, a conventional method for producing a vehicular endless track link involves sequentially performing the steps of forging a link material, quench-hardening the link material while the link material is at an elevated temperature (the elevated temperature being realized by either utilizing the residual heat of the forging step, by reheating the link material, or by a combination thereof), tempering the link material, machining the end surfaces of the link material, high-frequency induction-hardening a roller contact surface of the link material, tempering the roller contact surface, preliminarily machining a pin hole and a bushing hole, machine finishing the pin hole and the bushing hole, and machining nut seat surfaces of the link. As described above, the conventional method requires that separate induction-hardening and tempering steps be preformed specifically on the roller contact surface.

However, the conventional method illustrated in FIG. 5 and described above possesses several disadvantages.

First, because the roller contact surface is not subjected to induction-hardening or tempering until after the entire link has been hardened and tempered, the conventional method is characterized by a high thermal energy cost.

Second, because the entire link is tempered at a high temperature to allow for its machining after it has been quench-hardened, the hardness obtained from the quench-hardening step is not maintained in the resulting track link.

Two methods for producing a vehicular endless track wherein high-frequency induction-hardening is omitted on the roller contact surface have been proposed to overcome these disadvantages.

The first proposed method is disclosed in Japanese Patent Publication No. HEI 5-9488. According to this conventional method, during heat treatment the metallic crystal structure of the roller contact surface of the link is converted to martensite by rapidly cooling the roller contact surface within oil. The metallic crystal structure of a remaining portion of the link is converted to bainite by cooling the remaining portion in wind, so that high-frequency induction-hardening of the roller contact surface is unnecessary, while the remaining portion is relatively soft and can be machined.

According to the second method disclosed in Japanese Patent Publication No. SHO 57-51583, the portion of a link to be machined is tempered at a high temperature by induction-heating. Tempering a portion of the link is essential because if the entire link is hardened (i.e., if no portion is subjected to induction-heating), the link cannot be machined. In both of the above-mentioned methods, a portion of the link to be machined is heat-treated to be softer than the roller contact surface.

Although the method of Publication No. HEI 5-9488 has been found to overcome the above-described problem of high thermal energy cost associated with the convention method, it does not adequately solve the above-described second problem. Further, the productivity of the method is poor because the cooling method during hardening is complicated.

With respect to the method disclosed in Publication No. SHO 57-51583, it too resolves the above-described problem of high thermal energy cost. However, this method also does not overcome the above-described second problem. Further, because the machined portion is tempered at a high temperature, there are no large advantages with respect to cost and quality.

SUMMARY OF THE INVENTION

Accordingly, it is an object of the present invention to provide a method for producing a vehicular endless track link wherein the step of high-frequency induction-hardening of the roller contact surface of a link is omitted.

It is another object of the present invention to provide a method for producing a vehicular endless track link wherein the mechanical strength obtained from the step of quench-hardening the link can be effectively utilized.

It is a further object of the present invention to provide a method for producing a vehicular endless track link wherein several machining steps of the link material can be omitted by hot-trimming the link material during the forging step.

It is still a further object of the present invention to provide a method for producing a vehicular endless track link wherein the thermal energy costs are relatively low.

BRIEF DESCRIPTION OF THE DRAWINGS

These and other objects, features, and advantages of the present invention will become more apparent and will be more readily appreciated from the following detailed description of the preferred embodiment of the present invention when taken in conjunction with the accompanying drawings, in which.

DETAILED DESCRIPTION OF THE PREFERRED EMBODIMENT

Figure 1:
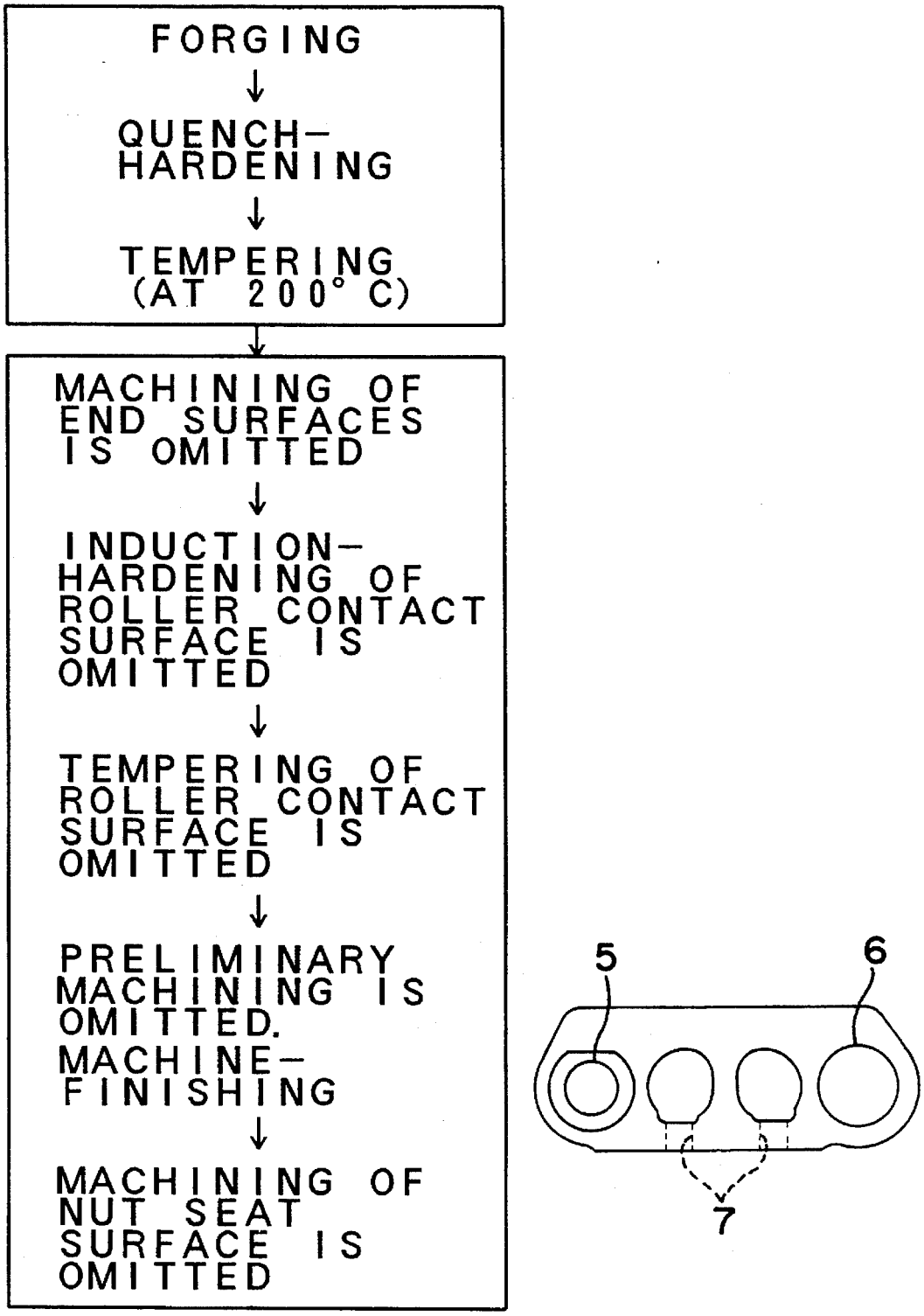
FIG. 1 is a diagram illustrating steps included in a method according to one embodiment of the present invention.
Figure 2:
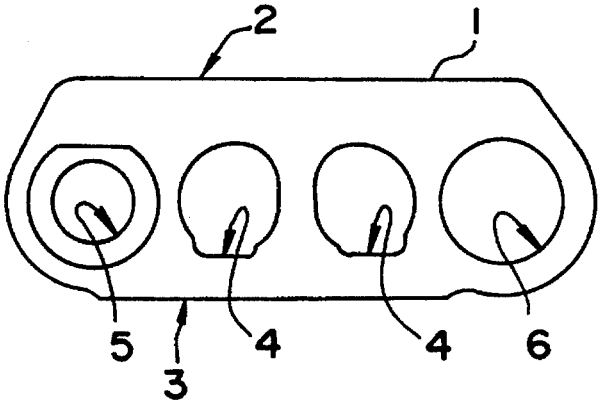
FIG. 2 is an elevational view of a link.

FIG. 1 illustrates the steps involved in a method for producing a vehicular endless track link according to one embodiment of the present invention. As illustrated in FIG. 1, a low-carbon boron steel is provided as a link material 1 (as shown in FIG. 2). The low-carbon boron steel has about 0.2% to about 0.3% carbon by weight and about 1 p.p.m. to about 100 p.p.m. boron by weight.

According to the embodiment of the present invention, the link material 1 is forged at about 1200° C. (i.e., 1200°±50° C.) to form a preliminary link shape. During the forging step, opposite end surfaces 2 and 3 (one of the end surfaces being designated as a roller contact surface), nut seat surfaces 4, a pin hole 5, and a bushing hole 6 are hot-trimmed (see FIG. 2). Because the temperature of about 1200° C. affects the mechanical properties of the link material 1 inasmuch as the link material 1 is thereby softened, the hot-trimming is easily performed and the link material 1 can be fashioned into a substantially final link shape.

After the link material 1 is formed into a substantially final link shape, the link material 1 is converted to martensite (having a metallic crystal structure) by quench-hardening. Quench-hardening is conducted by rapidly cooling the link material 1 from a temperature above about 760° C. using water, oil, or soluble liquid. The elevated temperature of above about 760° C. may be obtained by utilizing the residual heat of the forging step, by reheating the link material, or by a combination thereof. In the case where the quenching is preceded by reheating, the forged link material 1 is reheated to a temperature above $Ac_3$ transformation point before being rapidly cooled. As a result of the quench-hardening step, the entire link material 1 is hardened to a hardness above HRC (Rockwell Hardness) 42, and more preferably between about HRC 42 and about HRC 56.

Next, the quench-hardened link material 1 is preferably tempered at a temperature in the range of about 200°±50° C. This is in contrast to the above-described conventional method, wherein the link material 1 is tempered at about 500° C. The reason for the tempering at a relatively low temperature in the present invention is so that the martensite crystal structure is not destroyed. Accordingly, the high strength and high hardness of the link material 1 which results from the quench-hardening step are maintained. In the conventional method, since the link material 1 is tempered at a high temperature of about 500° C., the tensile strength of a core portion of the link material 1 is at about 90 $Kg/mm^2$. By contrast, in the method according to the present invention, a tensile strength of about 140 $Kg/mm^2$ and a hardness of about HRC 50 are obtained.

Figure 3:
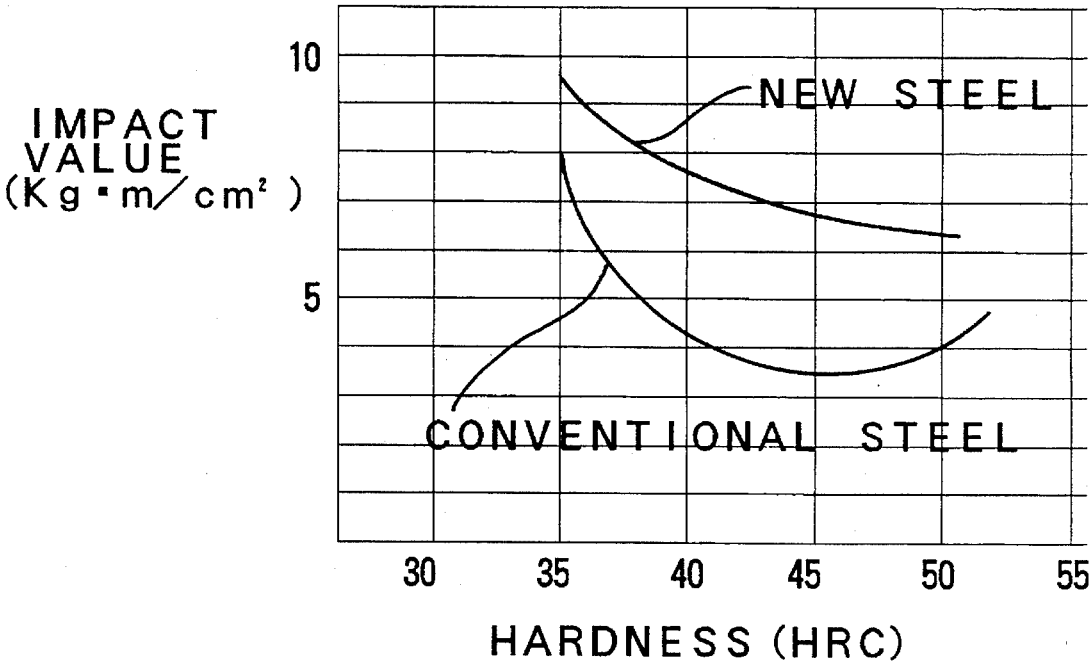
FIG. 3 is a comparative graph illustrating the impact value/hardness characteristics of a link prepared in the method according to an embodiment of the present invention and a link prepared in the above-described conventional method.

As shown in FIG. 3, even when the present invention is practiced to produce steel having a high hardness, the quench-hardened and tempered link material 1 nevertheless possesses a high impact value (e.g., above 5 $Kg{\cdot}m/cm^2$ impact value for a hardness of about 45 HRC). The high impact value is partially attributable to the presence of boron in the link material 1. As a result of the high impact value, the potential for crack formation in the link material 1 is suppressed. By contrast, when the hardness of conventional steel is increased to about HRC 45, the toughness (i.e., impact value) of the steel decreases. Consequently, such conventional steel cannot be effectively used as a link material 1. This problem is overcome by the method according to the present invention.

Figure 5:
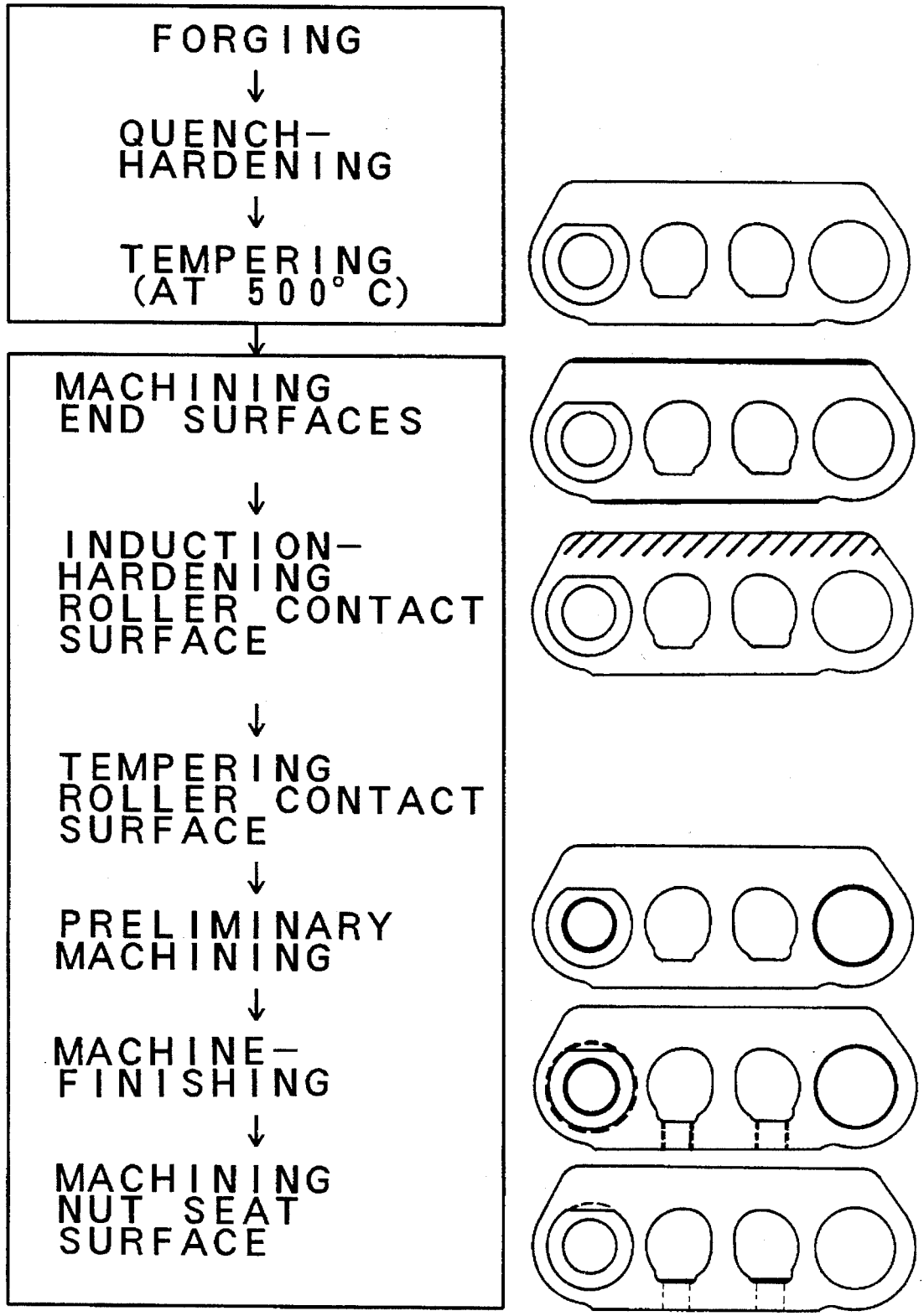
FIG. 5 PRIOR ART
FIG. 5 is a diagram illustrating steps included in the above-described conventional method.

The above-described embodiment of the present invention is particularly advantageous over the conventional method illustrated in FIG. 5 because it allows for the elimination of several of the process steps required by the conventional method. More specifically, in the conventional method, one end surface (a roller contact surface) is machined and then is locally induction-hardened and tempered. However, in the method according to the present invention, the steps of machining, induction-hardening, and tempering the roller contact surface are not required.

Avoidance of these additional steps (which are required by the conventional method) is attributable to the high degree of hardness imparted to the link material 1 from the quench-hardening and tempering steps of the present invention. Since the link material 1 is quench-hardened to a hardness above HRC 42, and preferably to a hardness in the range of about HRC 42 to about HRC 56, the roller contact surface of the link has a sufficiently high hardness and high wear resistance, such that the roller contact surface may be effectively utilized for its intended uses. More particularly, since the link material 1 is tempered at a low temperature after the quench-hardening according to an embodiment of the present invention, the metallic crystal structure of the martensite obtained by the quench-hardening is not destroyed. Accordingly, the hardness and strength imparted to the link material 1 as a result of the quench-hardening can be effectively utilized without requiring the above-mentioned additional process steps.

Furthermore, the steps of preliminarily machining a pin hole 5 and a bushing hole 6 in the link material 1 can be omitted by practicing the present invention. That is, in the method according to the present invention, the preliminary machining steps are not necessary; instead, the pin hole 5 and the bushing hole 6 may be directly machine finished. This is because the pin hole 5 and the bushing hole 6 have been shaped by the hot-trimming during the forging step to substantially approximate their desired respective final dimensions, the amount of machining required during the machine finishing step is reduced. Therefore, despite the high hardness of the link material 1, the machine finishing can easily be accomplished since the pin and bushing holes 5 and 6 are already substantially complete.

In addition, in accordance with the present invention the nut seat surfaces 4 do not require machining after the pin hole 5 and the bushing hole 6 are machine finished. However, if desired the machining of portions which were not hot-trimmed during the forging step, for example shoe-bolt holes 7 (see FIG. 1), may be preformed.

Finally, two of the above-described problems associated with the conventional method (i.e., the decrease in toughness of the link material 1 and the difficulty of machining the link material 1 after the quench-hardening and tempering) are overcome by the present invention.

Figure 4:
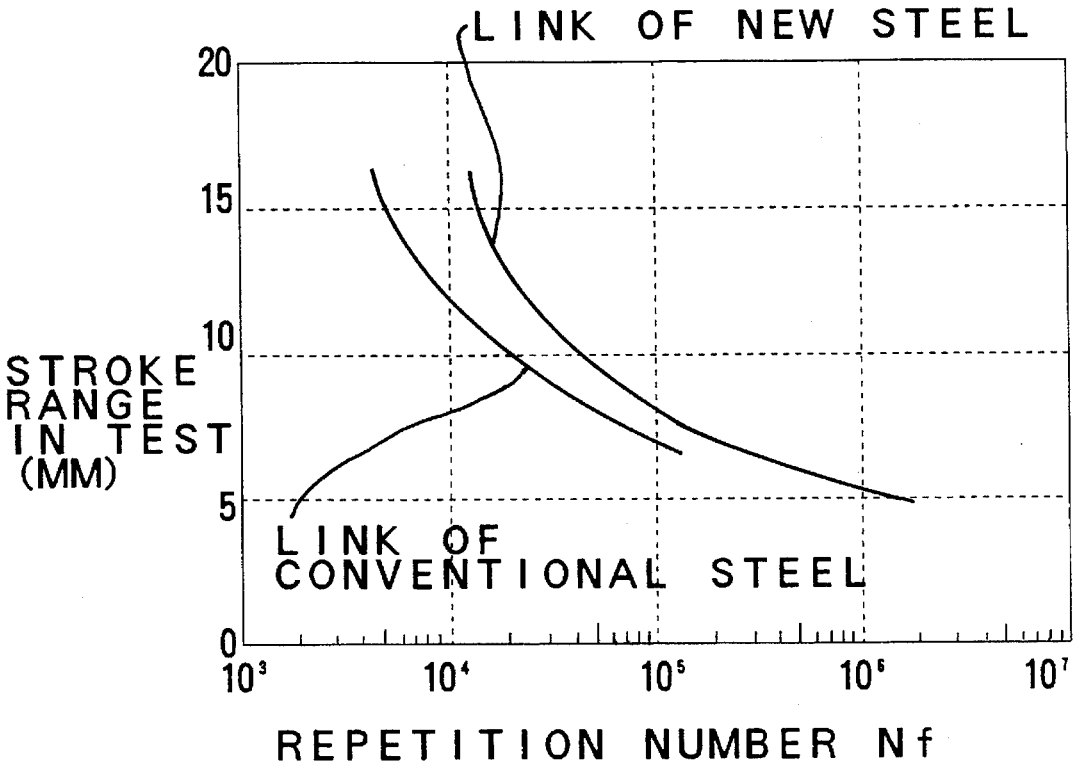
FIG. 4 is a graph illustrating twisting fatigue test results of a link prepared in the method according to an embodiment of the present invention and a link prepared in the above-described conventional method.

More specifically, with respect to the problem of insufficient toughness (see FIG. 3), since the low-carbon boron steel is selected as the link material 1, the link manufactured according to the method of the present invention has a toughness higher than about 5 $Kg{\cdot}m/cm^2$, even at a high-hardness range above HRC 42. Accordingly, no crack formations are likely to occur. As seen from the results of the twisting fatigue tests, which are illustrated in FIG. 4, the link manufactured according to the method of the present invention has a higher fatigue strength than the link manufactured according to the conventional method.

With respect to the problem of difficulty in machining that is associated with the conventional method, since process of hot-trimming the link material 1 during the forging step allows for the link material 1 to be fashioned into a shape that substantially corresponds to the desired final link shape, the only portions of the link material 1 that require machining are the pin hole 5 and the bushing hole 6. Further, since the pin hole 5 and the bushing hole 6 have been shaped to their substantially final dimensions by the hot-trimming during the forging step, less amount of machining (including grinding) is required to finish the link, thereby shortening the production time.

The parameters set forth above will now be discussed in more detail.

As noted above, the carbon content constitutes only about 0.2% to about 0.3% by weight of the composition of the low-carbon boron steel. The upper limit of about 0.3% carbon steel is ascertained by classification of carbon-containing steel as low-carbon steel, medium-carbon steel, or high-carbon steel depending on its carbon content. Respective carbon contents are as follows:

Low-carbon steel - - - below 0.3% by weight;

Medium-carbon steel - - - 0.3 to 0.5% by weight; and

High-carbon steel - - - above 0.5% by weight.

In the method of the present invention, since the low-carbon steel is preferably used, the upper limit is determined as 0.3% by weight from the definition of the low-carbon steel. Hardness and toughness are not compatible when medium-carbon steel and high-carbon steel are used.

Figure 6:
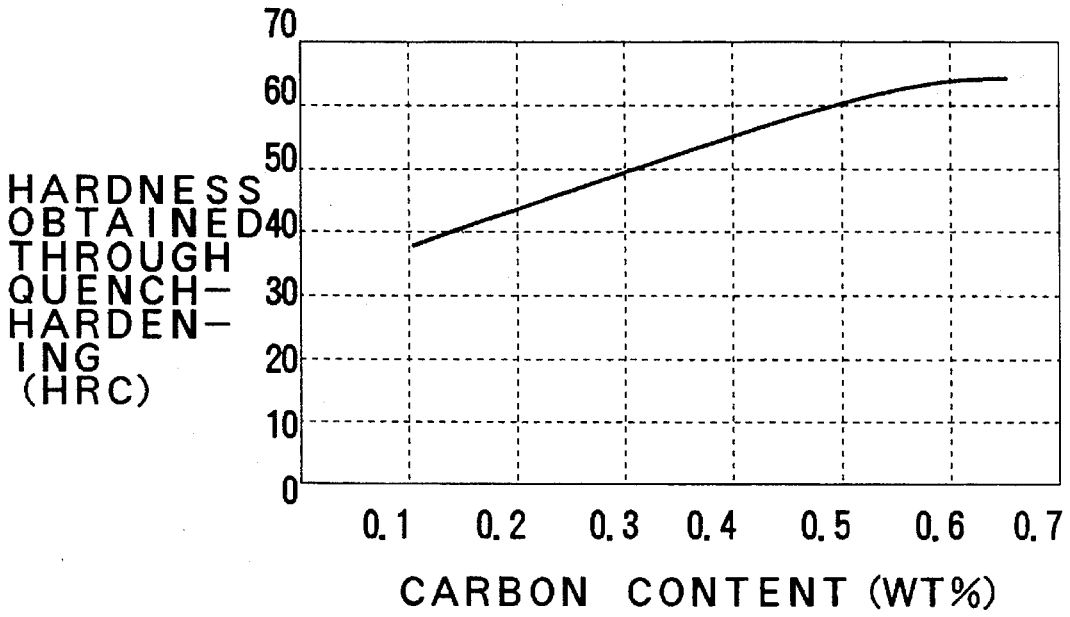
FIG. 6 is a graph illustrating the relationship between the hardness obtained as a result of subjecting the link material to the quench-hardening step and the carbon content of the link material.

The lower limit about 0.2% carbon content represents the minimum carbon content required to produce a link material 1 having an adequate hardness, which is obtained as a result of the quench-hardening step and is dependent upon the carbon content of the link material 1. More specifically, an increase in the carbon content results in a corresponding increase in hardness. In the method of the present invention, since it is preferable to obtain a hardness above HRC 42, the link material 1 should have a carbon content of more than 0.2% , as seen FIG. 6.

Figure 7:
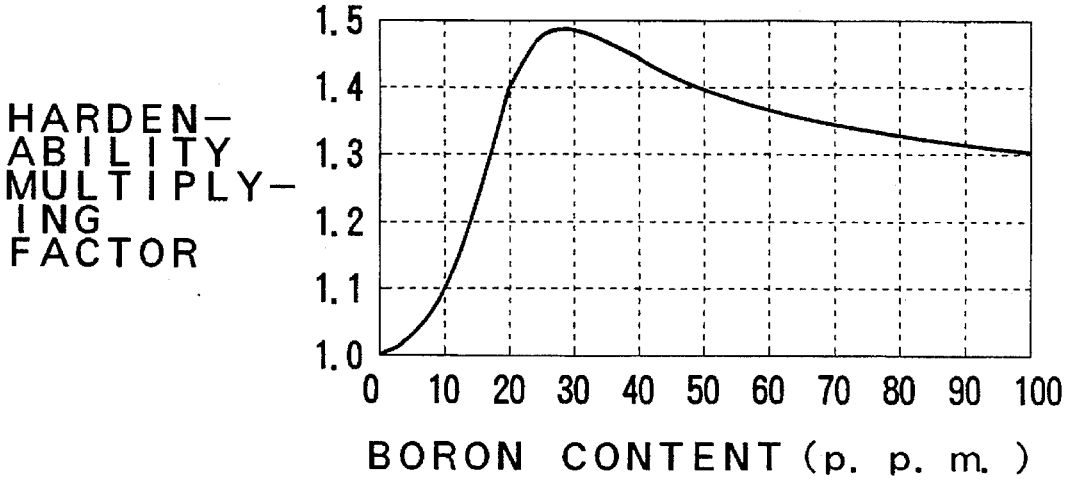
FIG. 7 is a graph illustrating a relationship between a hardenability multiplying factor and the boron content of the link material.

The reason for selecting a boron content between about 1 and about 100 p.p.m. is to improve the hardenability and toughness of the link. FIG. 7 illustrates the relationship between a hardenability multiplying factor and boron content. The hardenability multiplying factor is defined herein as the ratio of the hardenability of boron-containing steel to a hardenability of steel containing no boron.

As seen in FIG. 7, when the boron content is 0 p.p.m., the hardenability multiplying factor is 1.0. If a small amount of boron is added to the steel, the hardenability multiplying factor increases above 1.0. In other words, by allowing the steel to contain even a small amount of boron, the hardenability of the steel is improved as compared with a steel including no boron. Accordingly, the minimum range of boron is set at about 1 p.p.m. Moreover, as seen in FIG. 7, a maximum hardenability multiplying factor is obtained with a boron content of about 30 p.p.m. When the boron content exceeds about 30 p.p.m., the hardenability multiplying factor begins steadily decease. The hardenability multiplying factor eventually ceases its decline and levels off at a boron content of 100 p.p.m., which corresponds to a hardenability multiplying factor of about 1.3. That is, even if the boron content is increased above 100 p.p.m., the hardenability is not significantly affected. Instead, increasing the boron content above 100 p.p.m. is only accompanied by an increase in cost. Therefore, the upper limit for the boron content is determined as about 100 p.p.m. Preferably, the boron content is between 5 p.p.m. and about 30 p.p.m., and more preferably between about 20 p.p.m. and about 30 p.p.m.

The reason for selecting the forging temperature range as about 1200° C. (i.e., between 1150° C. and 1250° C.), is because if the forging temperature drops below 1150° C., the forgeability becomes low. As a result, it is difficult to fashion the link material 1 to the desired shape and dimensions. However, if the forging temperature is increased to a temperature above 1250° C., a scale may form on the surface of the link material 1, and the operating life of a forging die will be shortened. Furthermore, increasing the forging temperature above 1250° C. can result in coarsening the link material 1, thereby decreasing the toughness of the link material 1. For all these reasons, the upper limit of 1250° C. is selected.

Figure 8:
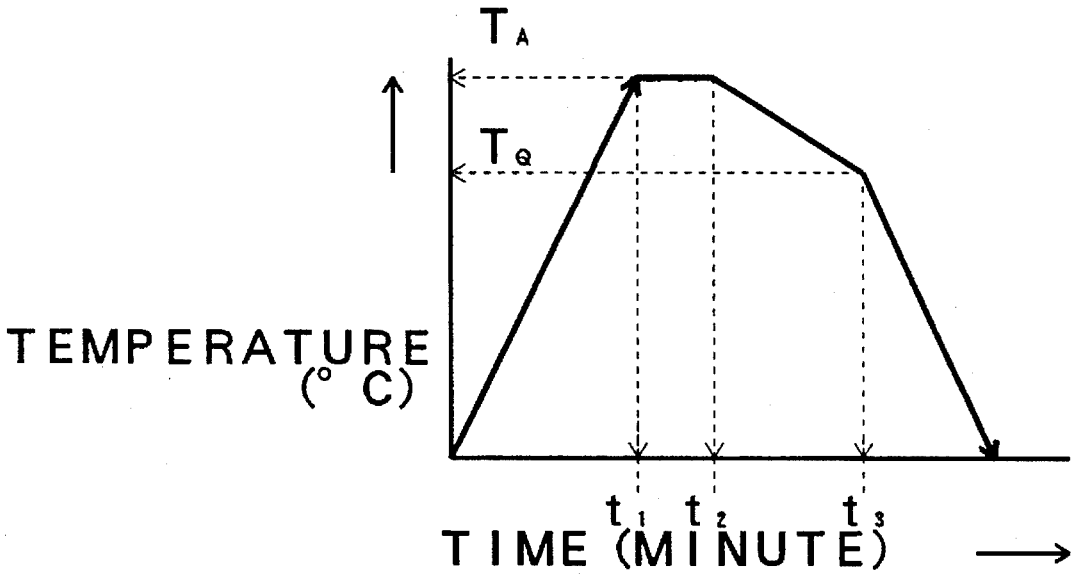
FIG. 8 is a graph illustrating the temperature of a link material during the quench-hardening step, when the link material is reheated.

The temperature range of about 760° C. from which the link material 1 is rapidly cooled is preferably 760°±20° C. FIG. 8 represents the temperature of the link material 1 as it is subjected to the process steps (e.g., the heating and rapid cooling that accompanies the quench-hardening step) of one embodiment of the present invention. In FIG. 8, $T_A$ represents the maximum temperature at which the link material 1 is heated. Such heating preferably occurs by heating in a furnace until a time greater than $t_1$, but the link material 1 may be heated by any equivalent heating source. $T_A$ is usually equal to the $Ac_3$ transformation point +30° C. At $t_2$, the link material 1 is removed from the heat source and allowed to cool until it reaches the temperature $T_Q$ at $t_3$. At $t_3$, the link material 1 is rapidly cooled in a cooling liquid. Even if $T_Q$ is as much as 100° C., lower than $T_A$, a satisfactory hardness is obtained if the cooling is effected fast enough.

The particular temperature range of 760° C.±20° C. is ascertained by examining the relationships among $Ac_3$, $T_A$, and $T_Q$, which are expressed by the following equations:

$$Ac_3(°C.)=922-224\times C\%-34\times Mn\% \quad (1)$$

$$T_A(°C.)=Ac_3+30 \quad (2)$$

$$T_Q(°C.)=T_A-100 \quad (3)$$

By inserting equations (1) and (2) into equation (3), equation (4) is obtained:

$$T_Q(°C.)=852-224\times C\%-34\times Mn\% \quad (4)$$

In the present invention, the carbon (C) content is about 0.2% to about −0.3% and the Mn content is preferably between about 0.8% and about −1.2%, such that the value of $T_Q$ is the smallest when C is 0.3% and Mn is 1.2%. Substituting these parameters into equation (4), $$T_Q=852-224\times 0.3-34\times 1.2=744(°C.).$$

Similarly, the largest value of $T_Q$ is calculated by substituting the values C of 0.2% and Mn of 0.8% into equation (4):

$$T_Q=852-224\times 0.2-34\times 0.8=780(°C.).$$

Averaging these two values together, the value of "about 760° C." is obtained as the temperature range from which the link material 1 is rapidly cooled. The value of about 760° C. should be generally understood as indicating a range of 760° ±20° C.

Figure 9:
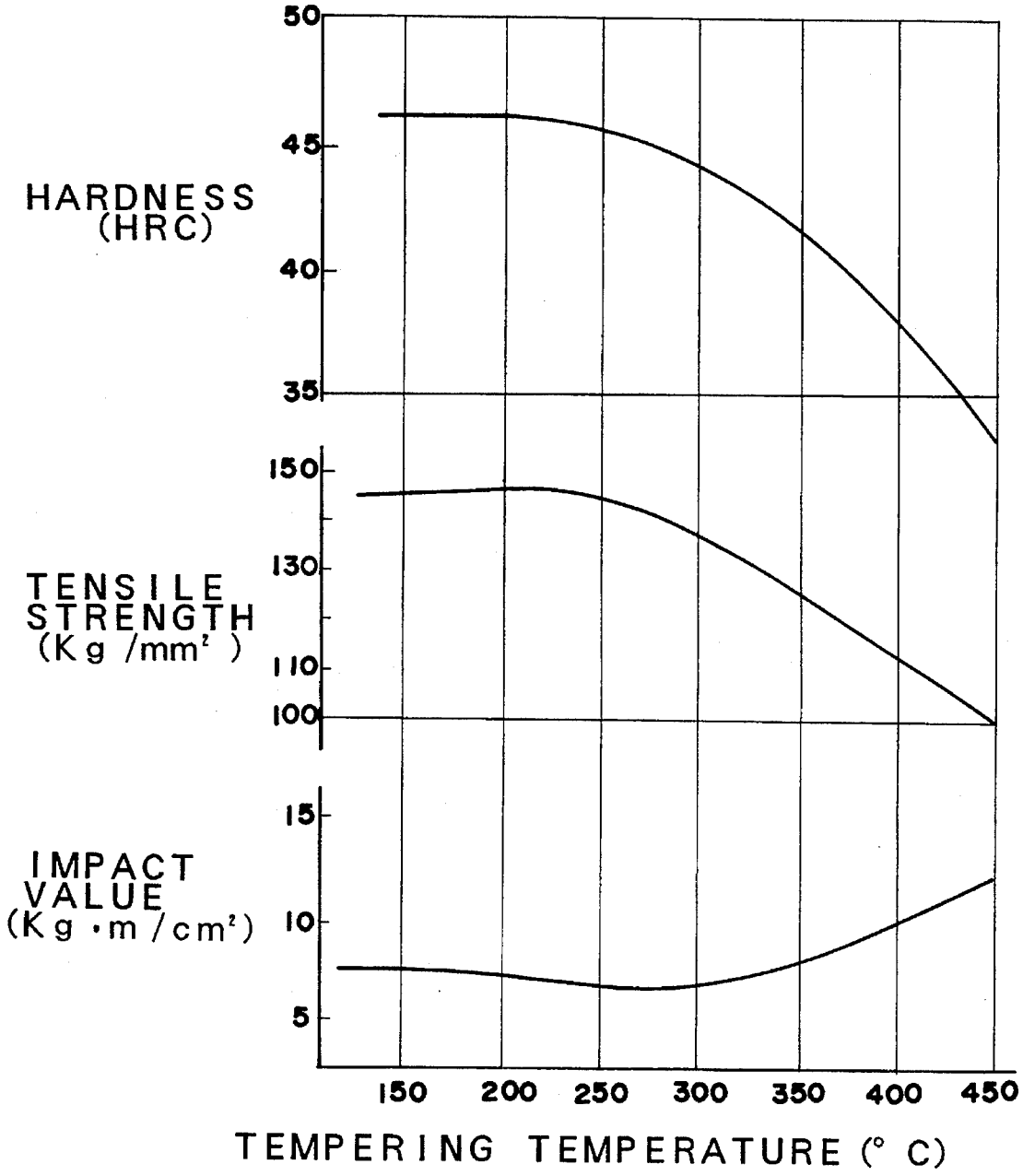
FIG. 9 is a graph illustrating the respective relationships between hardness, tensile strength, and impact value of the link material and tempering temperature.

The reason for the range of 200°±50° C. for the low-temperature tempering is as follows:

Relationships among the hardness, the impact value (toughness), and the tempering temperature for the link manufactured using the method according to the present invention are illustrated in FIG. 9. When the tempering temperature is in the range of 150° C. –250° C., that is, 200°±50° C., the hardness is almost constant and is about HRC 46, and also the toughness is almost constant and is in the range of 7.0 to 7.5 Kg·m/cm$^2$, even though the tempering temperature changes. This means that, in the range of 200°±50° C., the hardness and toughness are substantially uneffected by a change in the tempering temperature.

Figure 10:
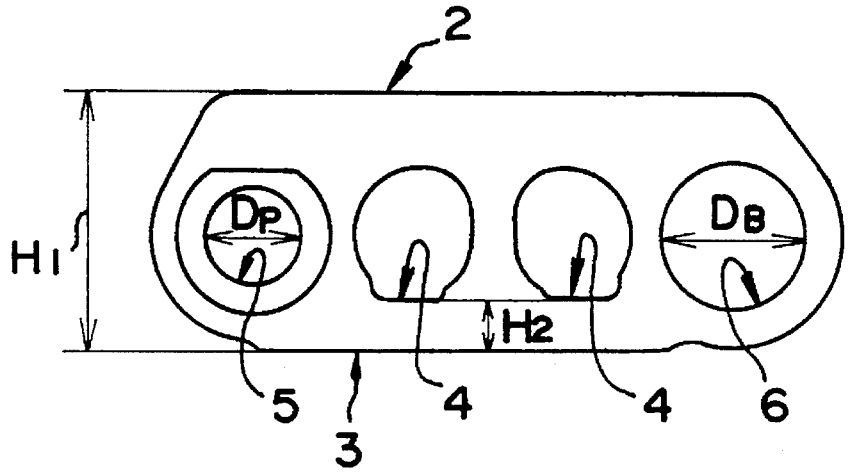
FIG. 10 is an elevational view of a forged link.

As used for the purposes of the present invention, the term "substantially final link shape", which is achieved by hot-trimming the link material during the forging step, is will now be explained. As illustrated in FIG. 10, the end surfaces 2 and 3 of the forged link are separated by a height $H_1$. Because the opposite end surfaces are not machined after the forging and hot trimming steps, the height $H_1$ is not significantly altered thereafter. Similarly, the height $H_2$ of the nut seat surface 4 is not machined after the forging and hot trimming steps. Accordingly, the height $H_2$ is not significantly altered thereafter.

However, the pin hole 5 having diameter $D_P$ is machine finished after forging. A clearance during machine finishing the pin hole is preferably about 1 mm measured in a diametrical direction of the pin hole, although the diameter may vary depending on the intended use of the link. Because the pin hole 5 is only machine finished and not subjected to preliminary machining, the pin hole diameter of the substantially final link shape, that is $D_P$, is about 1 mm smaller than that of final link product.

The bushing hole 6 having diameter $D_B$ is also machine finished after forging with a clearance of about 1 mm, although the diameter may vary depending on the intended use of the link. Because the bushing hole 6 is also only machine finished and not subjected to preliminary machining, the bushing hole diameter of the substantially final link shape, that is $D_B$, is about 1 mm smaller than that of final product.

According to the present invention, the following advantages are realized. First, since the entire link material 1 is quench-hardened and then tempered at a low temperature, the additional step of induction-hardening and tempering the roller contact surface of the link material is not required. Further, the hardness and strength imparted to the link material 1 by the quench-hardening step can be effectively utilized and maintained in the final link product.

Finally, since the link material 1 is hot-trimmed during the forging step to a configuration that substantially corresponds to the desired final link shape, the machine finishing step is performed only on the pin hole 5 and the bushing hole 6, so that the total amount of machining is reduced.

Although the present invention have been described in detail above with reference to specific embodiments, it will be appreciated by those skilled in the art that various modifications and alterations can be made to the particular embodiment shown without materially departing from the novel teachings and advantages of the present invention. Accordingly, it is to be understood that all such modifications and alterations are included within the spirit and scope of the present invention as defined by the following claims.

What is claimed is:

1. A method for producing a vehicular endless track link comprising the steps of:

forging a link material of low-carbon boron steel at a temperature about 1200° C.;

quench-hardening said link material by rapidly cooling said link material from a temperature above about 760° C. so that a metallic crystal structure of said link material is converted to martensite; and tempering said link material at a temperature of about 200° C.

2. A method according to claim 1, wherein said forging step includes the step of hot-trimming at least one end surface of said link material.

3. A method according to claim 2, wherein said step of hot-trimming forms at least a pin hole and a bushing hole in said link material.

4. A method according to claim 3, wherein said step of hot-trimming further forms nut-seat surfaces.

5. A method according to claim 2, further comprising the step of machine-finishing said at least one end surface of said link material.

6. A method according to claim 3, further comprising the step of machine finishing said pin hole and said bushing hole.

7. A method according claim 1, wherein said link material is low-carbon boron steel having between about 0.2% and about 0.3% carbon by weight and between about 1 p.p.m. and about 100 p.p.m. boron by weight.

8. A method according to claim 2, wherein said link material is low-carbon boron steel having between about 0.2% and about 0.3% carbon by weight and between about 1 p.p.m. and about 100 p.p.m. boron by weight.

9. A method according to claim 7, wherein said link material contains between about 5 p.p.m. and about 30 p.p.m. boron by weight.

10. A method according to claim 8, wherein said link material contains between about 5 p.p.m. and about 30 p.p.m. boron by weight.

11. A method according to claim 7, wherein said link material contains between about 20 p.p.m. and about 30 p.p.m. boron by weight.

12. A method according to claim 8, wherein said link material contains between about 20 p.p.m. and about 30 p.p.m. boron by weight.

13. A method according claim 1, wherein after said tempering step, said link material maintains a hardness above HRC 42.

14. A method according to claim 1, wherein after said tempering step, said link material maintains a hardness between about HRC 42 and about 56.

15. A method according to claim 13, wherein said link has a toughness higher than 5 (kg)(m)/(cm$^2$).

16. A method according to claim 14, wherein said link has a toughness higher than 5 (kg)(m)/(cm$^2$).

17. A method according to claim 1, further comprising the step of reheating said link material before quench-hardening.

* * * * *